US006453884B2

(12) United States Patent
Ushigome

(10) Patent No.: US 6,453,884 B2
(45) Date of Patent: Sep. 24, 2002

(54) FUEL SUPPLY DEVICE

(75) Inventor: Akira Ushigome, Gunma (JP)

(73) Assignee: Unisia Jecs Corporation, Atsugi (JP)

( * ) Notice: Subject to any disclaimer, the term of this patent is extended or adjusted under 35 U.S.C. 154(b) by 0 days.

(21) Appl. No.: 09/814,983

(22) Filed: Mar. 23, 2001

(30) Foreign Application Priority Data

Mar. 24, 2000 (JP) ..... 2000-085027

(51) Int. Cl.[7] ..... F02M 37/04

(52) U.S. Cl. ..... 123/509; 123/514; 137/565.22; 137/565.34

(58) Field of Search ..... 123/514, 509, 123/510, 456, 457; 137/565.34, 565.17, 565.22, 565.29, 565.33, 571

(56) References Cited

U.S. PATENT DOCUMENTS

| | | | | | |
|---|---|---|---|---|---|
| 4,838,307 | A | * | 6/1989 | Sasaki et al. | 137/574 |
| 4,860,714 | A | * | 8/1989 | Bucci | 123/514 |
| 5,197,444 | A | * | 3/1993 | Lang et al. | 123/514 |
| 5,743,239 | A | * | 4/1998 | Iwase et al. | 123/514 |
| 5,749,345 | A | * | 5/1998 | Treml | 123/456 |
| 5,992,394 | A | | 11/1999 | Mukaidani et al. | 123/509 |
| 6,062,203 | A | | 5/2000 | Takahashi et al. | 123/509 |
| 6,276,342 | B1 | * | 8/2001 | Sinz et al. | 123/514 |
| 6,283,142 | B1 | * | 9/2001 | Wheeler et al. | 137/265 |
| 6,341,623 | B1 | * | 1/2002 | Channing | 173/565.22 |
| 6,371,153 | B1 | * | 4/2002 | Fischerkeller et al. | 137/265 |

FOREIGN PATENT DOCUMENTS

| | | |
|---|---|---|
| JP | 9-268597 | 10/1997 |
| JP | 11-82209 | 3/1999 |
| JP | 11-101166 | 4/1999 |

* cited by examiner

*Primary Examiner*—Carl S. Miller
(74) *Attorney, Agent, or Firm*—Foley & Lardner

(57) ABSTRACT

A fuel supply device is provided for use with a fuel tank. The device comprises a mounting bracket suspended into the fuel tank. A fuel pump is mounted to the mounting bracket to pump fuel from the fuel tank to the outside of the fuel tank. A pressure regulator is mounted to the mounting bracket to regulate the pressure of the fuel led to the outside of the fuel tank from the fuel pump. A fuel return passage is defined by the mounting bracket, through which a part of the fuel pumped out from the fuel pump is led back into the fuel tank under operation of the pressure regulator. First and second suction pumps are mounted to the mounting bracket and sucks fuel from first and second given portions of the fuel tank by using a power possessed by the fuel flowing in the fuel return passage. First and second passages extend from the fuel return passage to the first and second suction pumps respectively to apply the fuel from the fuel return passage to the pumps to drive the same independently. If desired, the pressure regulator may be arranged in the outside of the mounting bracket.

20 Claims, 14 Drawing Sheets

FUEL SUPPLY DEVICE

BACKGROUND OF THE INVENTION

1. Field of the Invention

The present invention relates in general to fuel supply devices for motor vehicles, and more particularly to the fuel supply devices of a type that supplies fuel from a fuel tank to an engine of the vehicle.

2. Description of Related Art

In motor vehicles powered by a fuel combustion engine, a fuel supply device is commonly used, which has such a configuration that components, such as, a fuel pump, a fuel filter and a pressure regulator are assembled into an integral unit with the use of a mounting bracket made of plastics, and the integral unit is mounted in a fuel tank. This type fuel supply device is shown in, for example, Japanese Patent First Provisional Publications (Tokkai Hei) No. H9-268597 and No. H11-101166.

The fuel supply device of such type is composed of a mounting bracket attached to the upper part of the fuel tank and having its lower part suspended into the fuel tank, a fuel pump attached to the lower part of the mounting bracket within the fuel tank, for discharging fuel from the fuel tank to fuel injection valves of the engine, and a pressure regulator for regulating the pressure of the fuel fed to the fuel injection valves.

The fuel pump sucks fuel from the fuel tank through its suction side and discharges the fuel toward the fuel injection valves on the engine, and the pressure regulator returns an excess part of the discharged fuel into the fuel tank to keep the pressure of the fuel led to the fuel injection valves at a constant level.

With this arrangement, should the vehicle under cruising be sharply accelerated or decelerated with only a small fuel remained in the fuel tank, the liquid surface of the fuel in the fuel tank would largely incline, so that the fuel would become insufficient around the suction side of the fuel pump. Of course, in this case, sufficient amount of fuel can not be supplied to the engine. For eliminating such drawback, in some of the vehicles, the fuel tank is formed therein with a chamber portion which defines a fuel sump around the fuel pump.

Usually, the chamber portion for the fuel sump is provided by a bottomed cylindrical casing in which the fuel pump is accommodated. In the fuel supply device, a suction pump is connected to the return side of the pressure regulator, and is located in the bottom side of the chamber portion. This suction pump sucks up fuel outside of the chamber portion with the use of fuel flowing from the return side of the pressure regulator (return fuel) so as to feed this fuel together with the return fuel into the chamber portion, so that the suction side of the fuel pump is suppressed from being exposed above from the liquid surface of fuel.

In four wheel drive vehicles or the like, there is a type using a saddle-like fuel tank including a main tank and a sub-tank in view of a restriction caused by a layout. In this connection, Japanese Patent First Provisional Publication No. H11-82209 shows a suction pump for the saddle-like fuel tank. In this case, the fuel supply device is arranged on the main tank, and the suction pump is attached to a mounting bracket. The suction pump sucks up fuel in the sub-tank by using return fuel from the pressure regulator in order to return the fuel to the main tank.

SUMMARY OF THE INVENTION

In view of the above-mentioned conventional technology, in case of application of the fuel supply device to the fuel tanks of the type having above-mentioned chamber portion, the suction pump for the chamber portion is connected to the return side of the pressure regulator. While, in case of application of the fuel supply device to the above-mentioned saddle-like fuel tank, the suction pump for the saddle-like tank is provided on the mounting bracket.

Accordingly, in the above-mentioned conventional technology, the mounting bracket for the chamber portion has a structure different from that for the saddle-like tank. Thus, various kinds of mounting brackets have to be designed and manufactured for the vehicles. Of course, in this case, components for the fuel supply device are increased and thus the productivity of the fuel supply device is lowered.

Furthermore, in case of application of the fuel supply device onto vehicles of a type in which the chamber portion is arranged in the main tank of the saddle-like tank, it is necessary to employ two suction pumps. That is, a suction pump for the chamber portion and another suction pump for the saddle-like tank are needed, which are respectively and separately provided to the mounting bracket. Of course, in this case, the mounting bracket becomes complicated in shape, and the entire construction of the fuel supply device becomes large. Furthermore, the layout for arranging the two suction pumps is difficult.

It is therefore an object of the present invention to provide a fuel supply device which is free of the above-mentioned drawbacks.

That is, according to the present invention, there is provided a fuel supply device in which two suction pumps can be easily attached to a mounting bracket, and the mounting bracket can be commonly used for both the fuel tank with a chamber portion and the saddle-like fuel tank.

According to a first aspect of the present invention, there is provided a fuel supply device for use with a fuel tank and a pressure regulator, which comprises a mounting bracket adapted to be suspended into the fuel tank; a fuel pump mounted to the mounting bracket to pump fuel from the fuel tank to the outside of the fuel tank; a fuel return passage defined by the mounting bracket, into which a part of the fuel pumped out from the fuel pump is led under operation of the pressure regulator; and first and second suction pumps mounted to the mounting bracket and sucking fuel from first and second given portions of the fuel tank by using a power possessed by the fuel led into the fuel return passage, a first passage having one end directly opened to the fuel return passage and the other end connected to the first suction pump; and a second passage having one end directly opened to the fuel return passage and the other end connected to the second suction pump.

According to a second aspect of the present invention, there is provided a fuel supply device which comprises a fuel tank for containing fuel; a mounting bracket having an upper part connected to an upper part of the fuel tank and a lower part suspended into the fuel tank; a fuel pump mounted to the lower part of the mounting bracket to pump fuel in the fuel tank to the outside of the fuel tank; a pressure regulator mounted to the lower part of the mounting bracket to regulate the pressure of fuel led to the outside of the fuel tank; a fuel return structure integral with the mounting bracket, the fuel return structure having a fuel return passage through which a part of the fuel pumped out from the fuel pump is led back into the fuel tank; first and second suction pumps for conveying fuel from first and second given portions of the fuel tank to a major portion of the fuel tank by using a power possessed by the fuel flowing in the fuel return passage of the fuel return structure; a first mounting structure integral with the mounting bracket and having the first suction pump mounted thereto, the first mounting structure having a first passage through which the fuel from the fuel return passage flows for driving the first suction pump; and a second mounting structure integral with the mounting bracket and having the second suction pump mounted thereto, the second mounting structure having a second passage through which the fuel from the fuel return passage flows for driving the second suction pump, the first and second passages being connected to the fuel return passage independently.

According to a third aspect of the present invention, there is provided a fuel supply device for use with a fuel tank, which comprises a mounting bracket adapted to be suspended into the fuel tank; a fuel pump mounted to the mounting bracket to pump fuel from the fuel tank to the outside of the fuel tank; a pressure regulator mounted to the mounting bracket to regulate the pressure of fuel led to the outside of the fuel tank by returning a part of the fuel from the fuel tank into the fuel tank; a fuel return passage defined by the mounting bracket, through which the part of the fuel pumped out from the fuel pump is led back to the fuel tank under operation of the pressure regulator; first and second suction pumps mounted to the mounting bracket and sucking fuel from first and second given portions of the fuel tank by using a power possessed by the fuel led into said fuel return passage; a first passage having one end directly opened to the fuel return passage and the other end connected to the first suction pump; and a second passage having one end directly opened to the fuel return passage and the other end connected to the second suction pump.

According to a fourth aspect of the present invention, there is provided a fuel supply device for use with a fuel tank and a pressure regulator, which comprises a mounting bracket adapted to be suspended into the fuel tank; a fuel pump mounted to the mounting bracket to pump fuel from the fuel tank to the outside of the fuel tank; a fuel return passage defined by the mounting bracket, into which a part of the fuel pumped out from the fuel pump is led under operation of the pressure regulator; first and second suction pumps mounted to the mounting bracket and sucking fuel from first and second given portions of the fuel tank by using a power possessed by the fuel led into the fuel return passage; a first passage having one end directly opened to the fuel return passage and the other end connected to the first suction pump; and a second passage having one end directly opened to the fuel return passage and the other end connected to the second suction pump.

BRIEF DESCRIPTION OF THE DRAWINGS

Other objects and advantages of the present invention will become apparent from the following description when taken in conjunction with the accompanying drawings, in which.

DETAILED DESCRIPTION OF THE EMBODIMENTS

Figure 1:
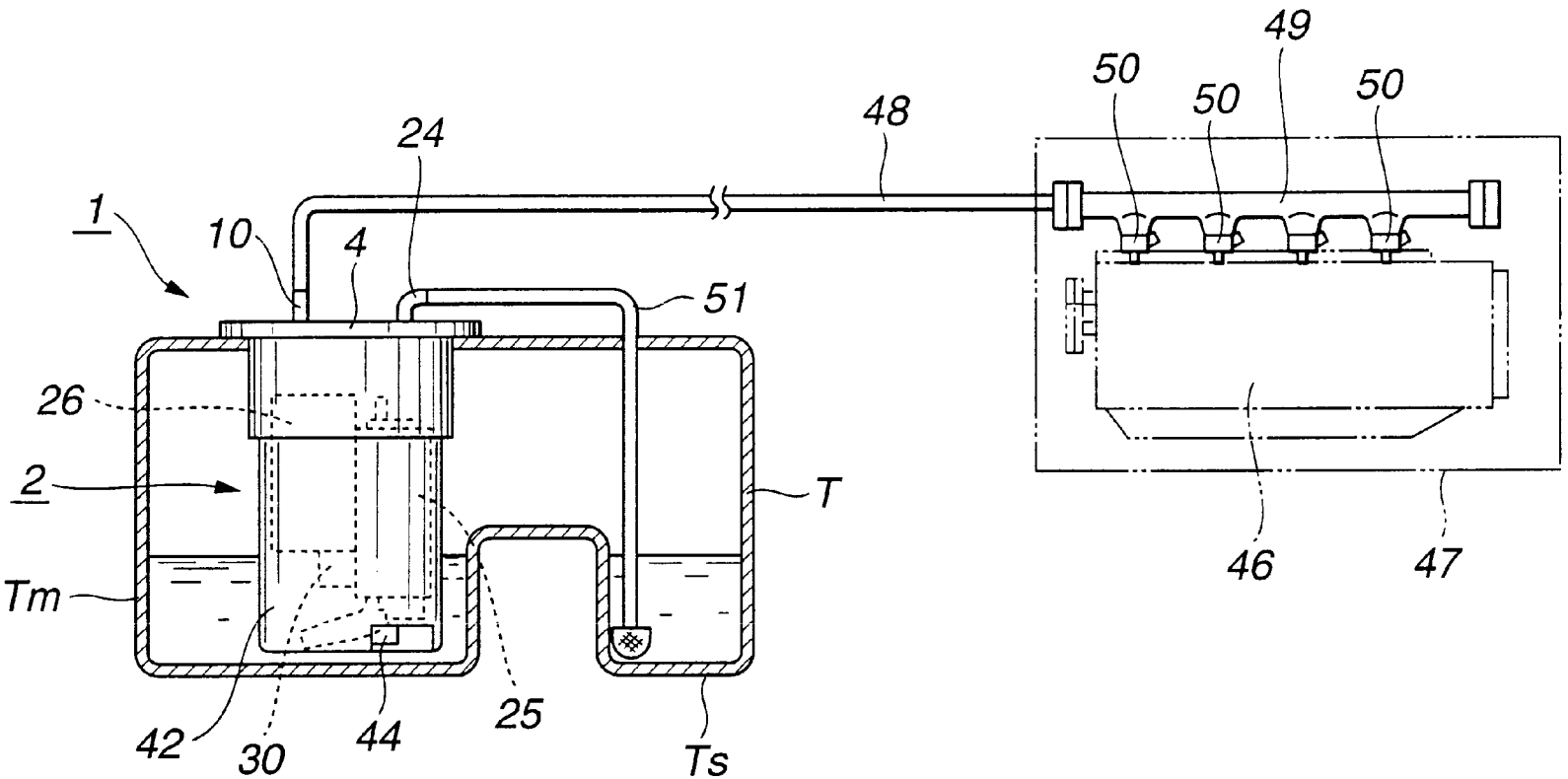
FIG. 1 is a schematic view of a fuel supply system of non-return type to which a fuel supply device of a first embodiment of the present invention is practically applied.

In the following, fuel supply devices of five embodiments of the present invention will be described in detail with reference to the accompanying drawings.

For ease of understanding, various directional terms, such as, upper, lower, right, left, upward, downward and the like are used in the following description. It is however to be noted that such terms are to be understood with respect to only the drawing or drawings on which the corresponding member or portion is illustrated.

Referring to FIGS. 1 to 10, there is shown a first embodiment of the present invention. In the drawings, denoted by numeral 1 is a fuel supply device of the first embodiment, which is mounted on a motor vehicle.

The fuel supply device 1 is incorporated with a fuel tank T mounted on the motor vehicle. The fuel tank T is formed of a saddle-like tank including a main tank Tm and a sub-tank Ts. The fuel supply device 1 is fixed to an upper wall portion of the main tank Tm, and is suspended in the main tank Tm, as shown.

In the fuel supply device 1 of the first embodiment, a pressure regulator 30, which will be described in detail hereinafter, is located in the fuel tank T, and a fuel pipe 49 extending from the fuel supply device 1 has a downstream end that is closed. Thus, the fuel supply device 1 constitutes part of a so-called non-return type fuel supply system.

As is seen from FIGS. 2 to 6, the fuel supply device 1 comprises a mounting bracket 2, a fuel pump 25, a fuel filter 26, a pressure regulator 30, a chamber member 42, and two suction pumps (viz., first and second suction pumps) 44 and 45, which will be explained in detail hereinafter.

Figure 6:
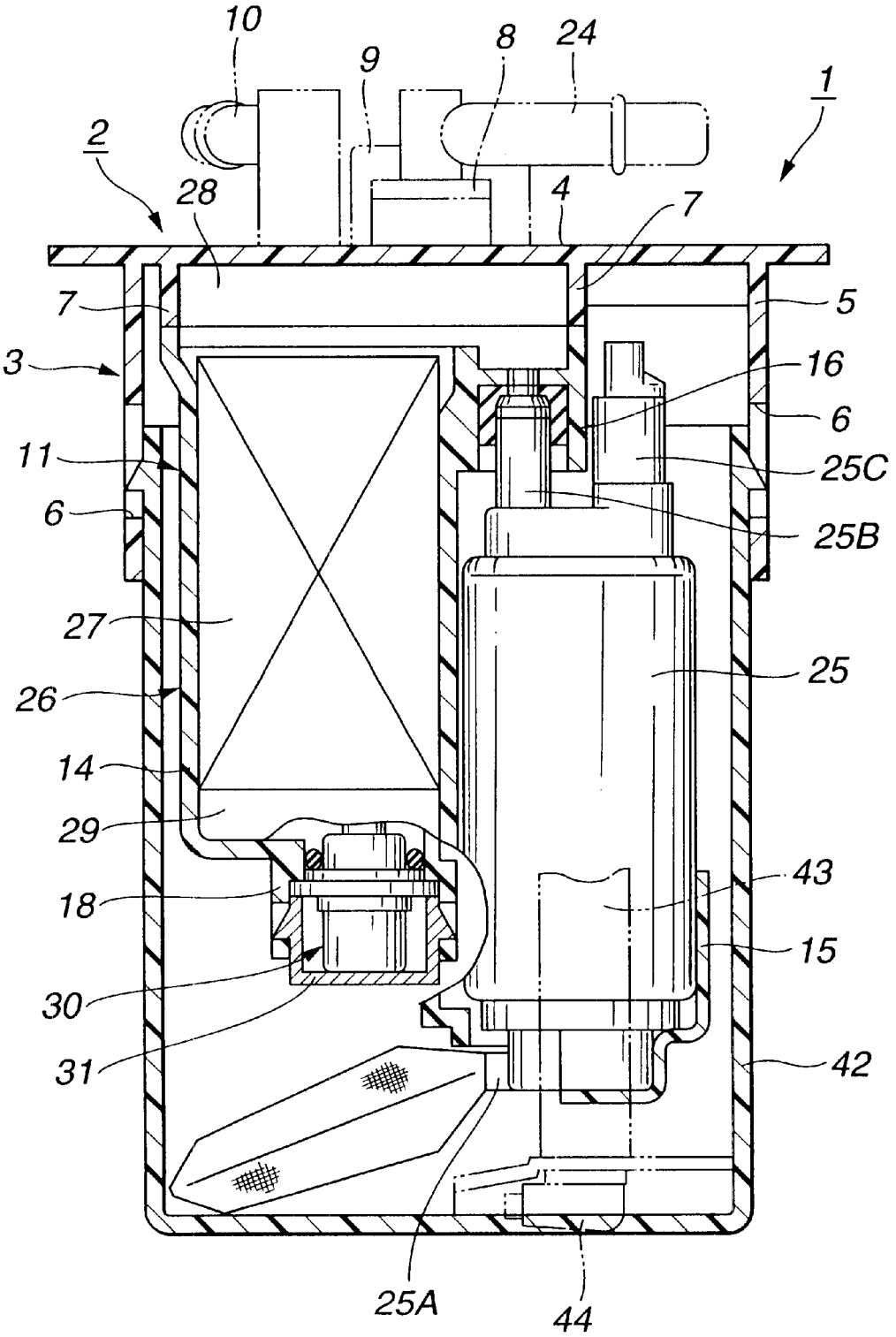
FIG. 6 is a sectional view taken along the line VI—VI of FIG. 4.
Figure 7:
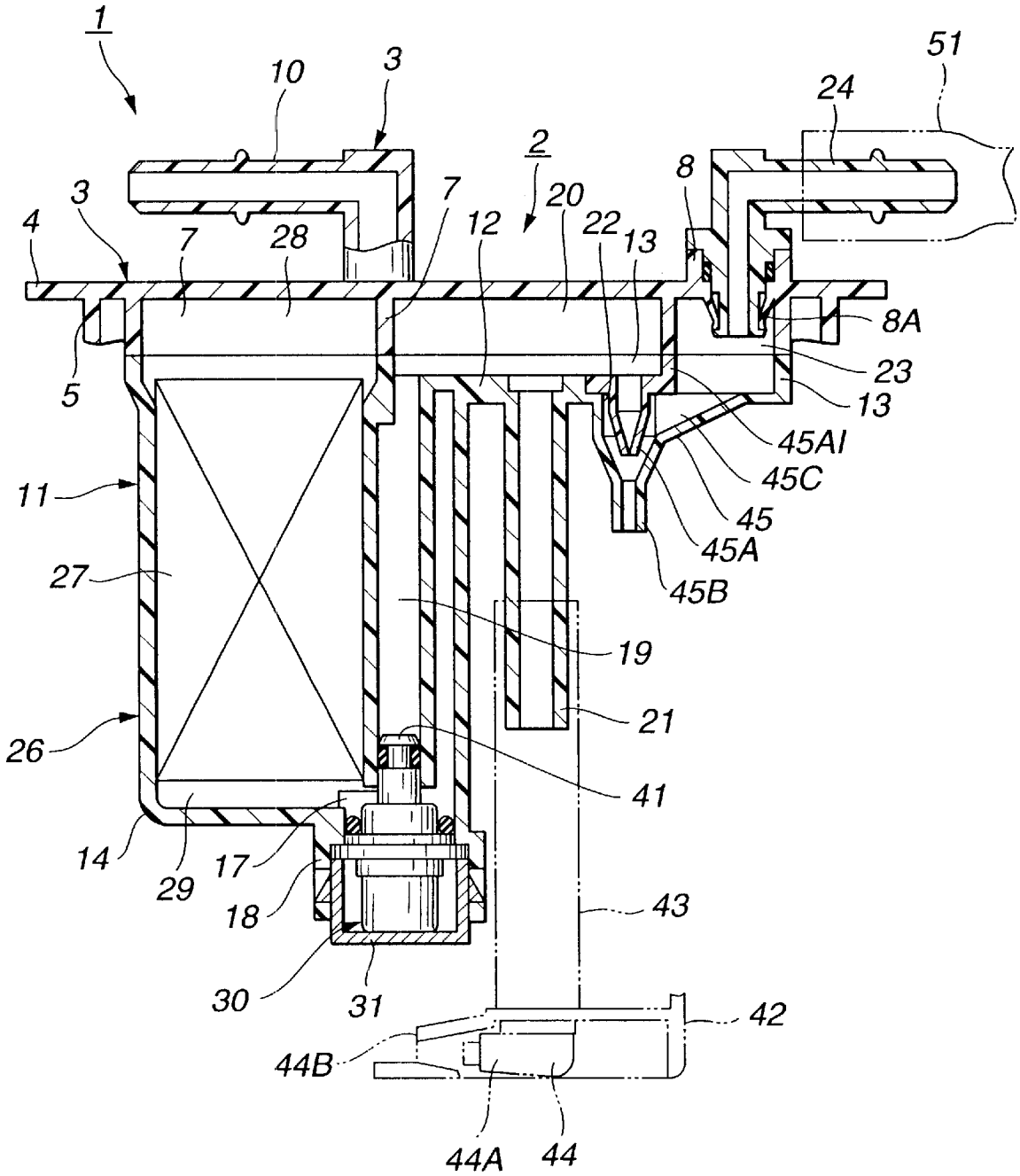
FIG. 7 is a sectional view taken along the line VII—VII of FIG. 4.

The mounting bracket 2 constitutes a structural base part of the fuel supply device 1, and as is seen from FIGS. 6 and 7, the mounting bracket 2 comprises an upper section 3 and a lower section 11.

The upper section 3 is an integral body made of plastics, which comprises a circular upper panel part 4, and a cylindrical outer barrel 5 projected downward from the lower surface of the circular upper panel part 4, the cylindrical outer barrel 5 being formed with a plurality of connecting holes 6 through which an after-mentioned chamber member 42 is attached to the cylindrical outer barrel 5.

The upper section 3 further comprises a plurality of partitions 7 which are located within the outer barrel part 5 and projected downward from the lower surface of the circular upper panel part 4, and an after-mentioned supply pipe 10.

Upon the fuel supply device 1 being mounted on the fuel tank T (see FIG. 1), the circular upper panel part 4 is arranged to cover a mounting aperture which is formed in an upper wall of the fuel tank T to dispose therethrough the device 1. Under this condition, the cylindrical outer barrel 5 is disposed in the mounting aperture.

As is seen from FIGS. 6 and 7, the partition walls 7 of the upper section 3 are joined, at their lower ends, with partitions 13 of the lower section 11, a filter casing 14 and a connection barrel 16 by means of bonding, welding or the like, as will be detailed hereinafter.

Figure 3:
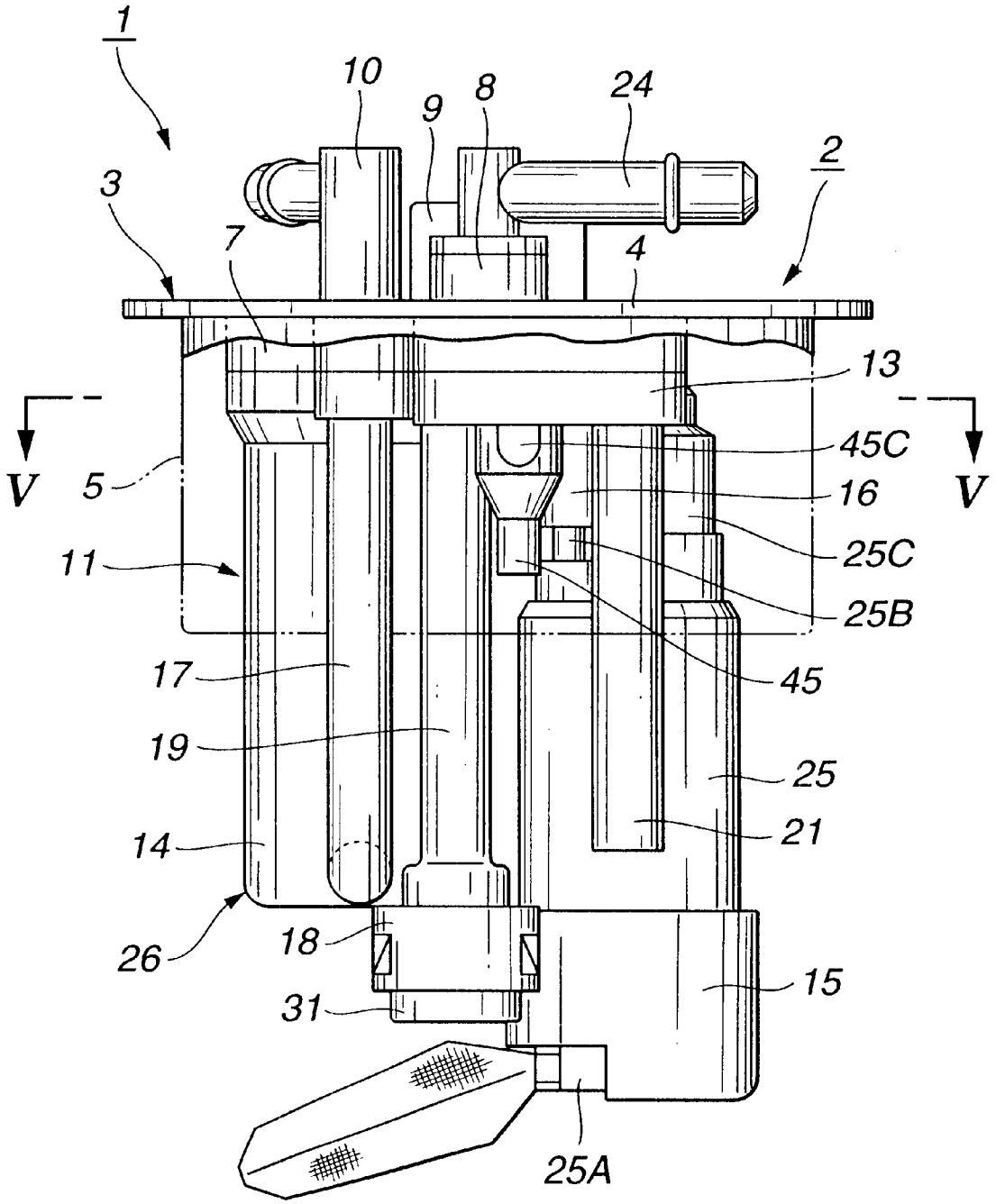
FIG. 3 is a view similar to FIG. 2, but a view with a chamber member removed.

As is seen from FIGS. 3 and 7, the circular upper panel part 4 is formed thereon with a boss part 8 for attaching a suction pipe 24. As is seen from FIG. 7, the boss part 8 is positioned just above an after-mentioned fuel suction chamber 23 to provide a communication between the suction pipe 24 and the chamber 23. The boss part 8 is formed at its inner side with engaging pawls 8A that are adapted to be engaged with the suction pipe 24.

Figure 4:
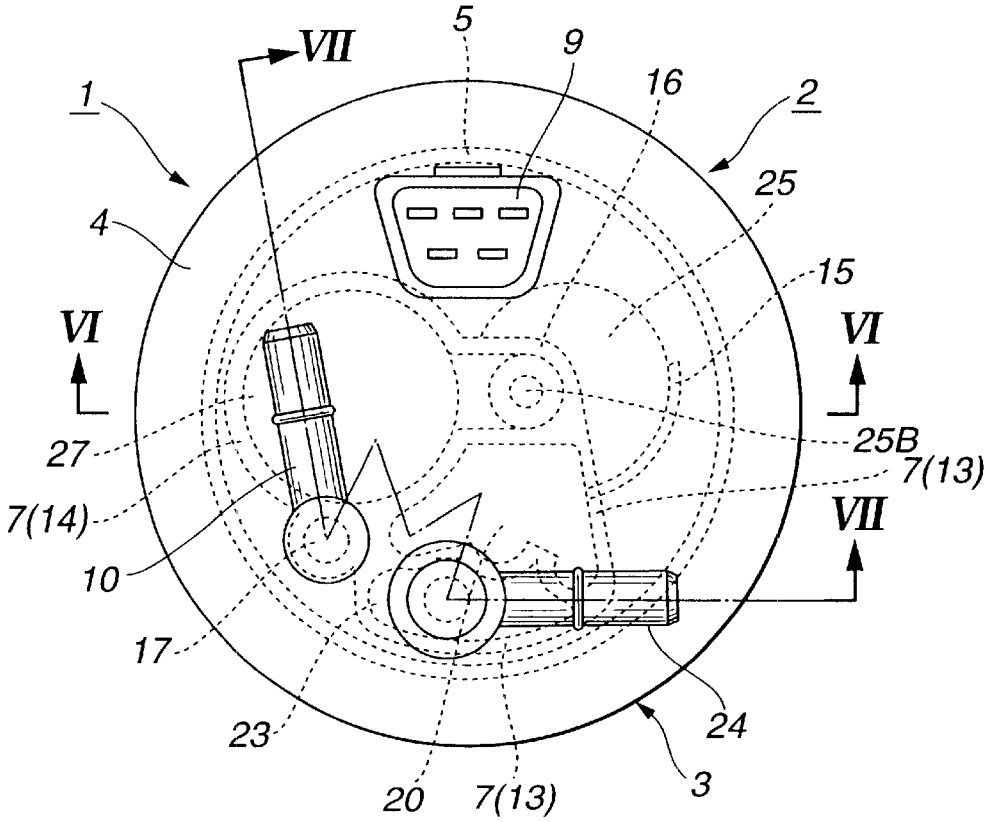
FIG. 4 is a plan view of the fuel supply device of the first embodiment.

As is seen from FIG. 4, the circular upper panel part 4 is provided with a connector 9 for feeding electric power to the fuel pump 25, as explained below.

Figure 5:
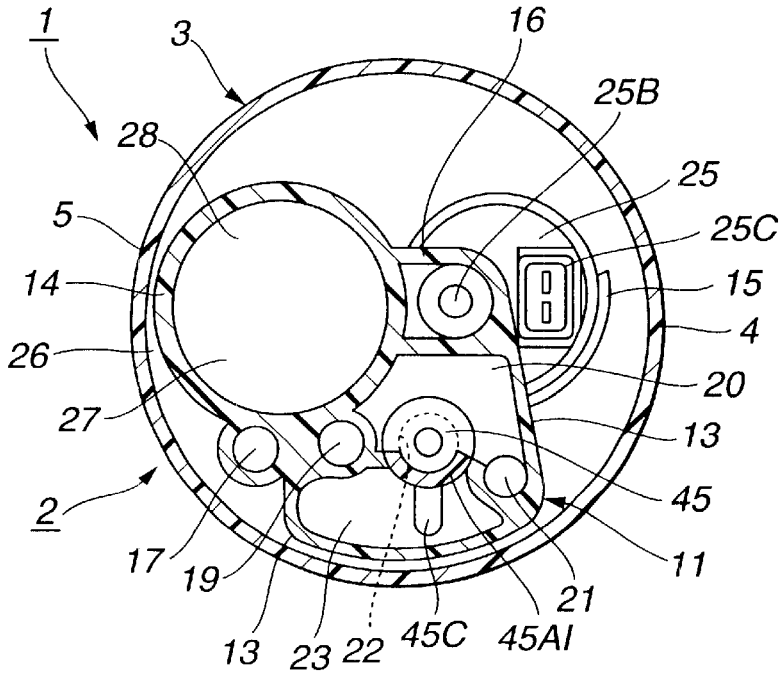
FIG. 5 is a sectional view taken along the line V—V of FIG. 3.

As is seen from FIGS. 5 and 6, the supply pipe 10 provided by the upper section 3 has an upper part in an L-shape, which is projected upward from the circular upper panel part 4 and thus projected outward from the fuel tank T. While, a lower part of the supply pipe 10 pierces through the upper panel part into the fuel tank T. The projected lower end of the supply pipe 10 is connected with an after-detailed supply pipe 17. The supply pipe 10 is adapted to feed fuel from the fuel pump 25 toward fuel injection valves 50 of the engine.

As is seen from FIGS. 6 and 7, the lower section 11 of the mounting bracket 2 is integrally formed of plastics and is connected to the lower ends of the above-mentioned upper section 3 by means of bonding, welding or the like.

As is seen from FIG. 7, the lower section 11 comprises a lower panel part 12 laid in a substantially horizontal direction along the upper panel part 4 of the upper section 3, and a plurality of partitions 13 projected upward from the lower panel part 12. The partitions 13 are joined to the partitions 7 of the upper section 3. With this joining, a fuel return passage 20 and the above-mentioned suction chamber 23 are defined between the upper section 3 and the lower section 11, which are isolated from each other.

As is seen from FIGS. 6 and 7, the lower section 11 is configured to include therein the filter casing 14, a pump mounting part 15, a connection barrel part 16, the supply pipe 17, a regulator mounting part 18, a return pipe 19, a suction pump mounting barrel part 21 and a suction pump fitting hole 22. Furthermore, the lower section 11 is constructed to hold a sub-tank suction pump 45 which will be described later.

The filter casing 14 is provided by the lower panel part 12 as a part of the fuel filter 26. The filter casing 14 is formed of a bottomed cylindrical casing having an upper end which is opened. The upper open end of the filter casing 14 is joined to the partitions 7 of the upper section 3 so as to be closed.

As shown in FIGS. 5 and 6, the pump mounting part 15 is integrally incorporated with the outer periphery of the lower part of the filter casing 14, and is formed of a bottomed barrel body that is provided, in its cylindrical wall, with an opening. Furthermore, the upper part of the filter casing 14 is integrally formed at its outer periphery with the connection barrel part 16 to which an after-mentioned discharge port 25B of the fuel pump 25 is connected. That is, the connection barrel part 26 functions to connect the discharge port 25B of the fuel pump 25 with an inflow chamber 28 of the fuel filter 26.

As is seen from FIGS. 3 and 7, the supply pipe 17 extends vertically on the outer side of the filter casing 14. The supply pipe 17 connects an after-mentioned outflow chamber 29 of the fuel filter 26 to the above-mentioned supply pipe 10. A part of fuel discharged from the discharge port 25 of the fuel pump 25 is led to the outside of the fuel tank T through the fuel filter 26, the supply pipe 17 and the supply pipe 10.

As is seen from FIG. 7, the regulator mounting part 18 is a part to which the pressure regulator 30 is attached. The regulator mounting part 18 is formed of a shorter cylindrical body that is secured to the lower part of the filter casing 14 and is communicated at its inner peripheral side with the outflow chamber 29 of the fuel filter 26.

As is seen from FIGS. 3 and 7, the return pipe 19 extends vertically on the outer peripheral side of the filter casing 14, which is communicated at its upper part with the fuel return passage 20 and is opened at its lower part to the center of the regulator mounting part 18. The return pipe 19 is adapted to lead a part of fuel discharged from the fuel pump 25, which flows (as return flow) from a return port 41 of the pressure regulator 30, into the fuel return passage 20.

As is seen from FIGS. 5 and 7, the fuel return passage 20 is formed in the mounting bracket 2, which is defined between the upper section 3 and the lower section 11 and is connected to the return port 41 of the pressure regulator 30 through the return pipe 19.

As is seen from FIGS. 5 and 7, the suction pump mounting barrel part 21 is a first suction pump mounting part provided to the mounting bracket 2, which has an upper part integrally incorporated with the lower panel part 12 of the lower section 11 and is opened to the fuel return passage 20. The suction pump mounting barrel part 21 is projected downward from the lower section 11 toward the bottom part of the fuel tank T. and is attached at its lower part to an after-mentioned chamber suction pump (viz., first suction pump) 44 through a pump pipe 43. Further, the suction pump mounting barrel part 21 is adapted to cause the return fuel in the fuel return passage 20 to flow toward the chamber suction pump 44.

Figure 9:
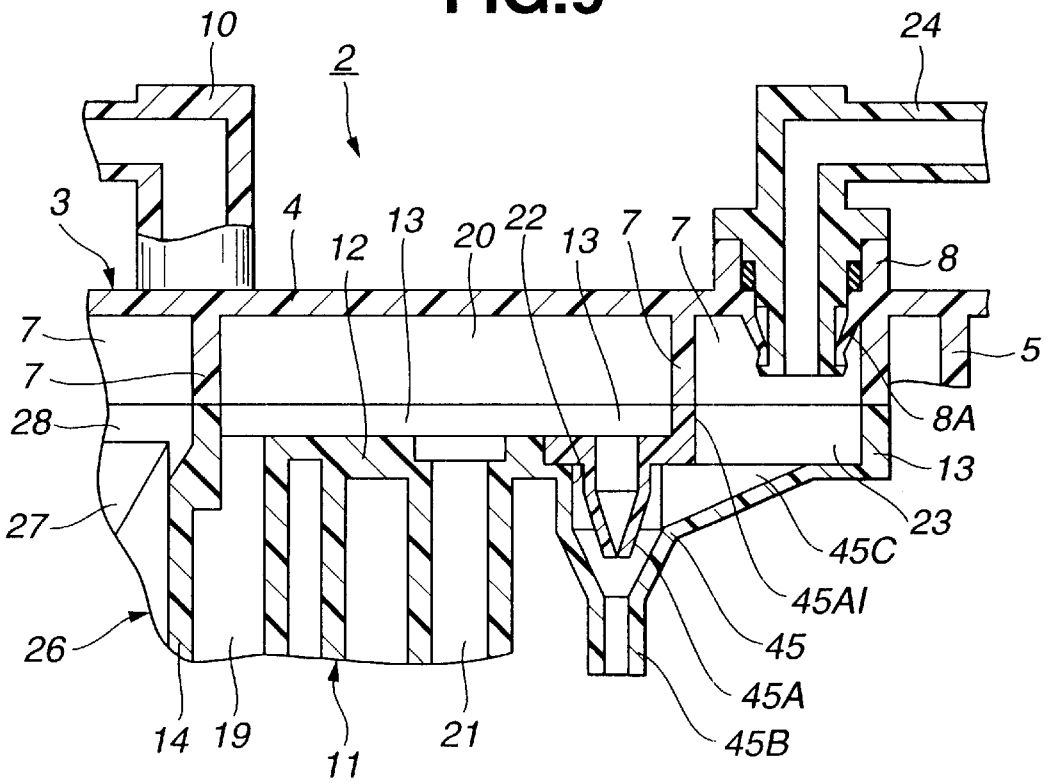
FIG. 9 is an enlarged sectional view of an essential part of a mounting bracket.

As is seen from FIGS. 5 and 9, the suction pump fitting hole 22 is a second pump mounting part provided to the mounting bracket 2, which is integrally incorporated with the lower panel part 12 of the lower section 11 and is opened to the fuel return passage 20 in parallel with the suction pump mounting part 21. Further, the suction pump fitting hole 22 is attached thereto with a nozzle part 45A of a sub-tank suction pump (viz., second suction pump) 45. The suction pump fitting hole 22 is adapted to cause the return fuel in the fuel return passage 20 to flow toward the sub-tank suction pump 45.

As is seen from FIGS. 5 and 7, the fuel suction chamber 23 is a fuel introduction part provided in the mounting bracket 2, which is located in the vicinity of the fuel return passage 20. Fuel is introduced into the suction fuel chamber 23 from the sub-tank Ts of the fuel tank T through the suction pipe 24 and a suction pipe 51. The fuel is adapted to flow into a suction part 45B of the sub-tank suction pump 45.

The L-shaped suction pipe 24 is provided on the upper surface side of the mounting bracket 2, which has a base end removably fitted in the boss part 8 of the upper section 3, as is seen from FIG. 9, and is held by the engaging pawls 8 of the latter. The suction pipe 24 is projected at its leading end outward from the fuel tank T, and is connected to the suction pipe 51.

The fuel pump 25 is cylindrical in shape and mounted on the pump mounting part 15 of the mounting bracket 2. As is seen from FIGS. 5 and 6, the fuel pump 25 is provided with a suction port 25A fitted thereto with a suction filter, the discharge port 25B fitted in the connection barrel part 16 of the mounting bracket 2 through the intermediary of a seal member, and a wire connection part 25C connected to the connector 9. Further, fuel pump 25 is adapted to suck up fuel in a chamber member 42 through the suction port 25*a*, and to discharge the fuel into the inflow chamber 28 of the fuel filter 26 through the discharge port 25B.

As is seen from FIGS. 5 to 7, the fuel filter 26 is provided to the mounting bracket 2, which is composed of the filter casing 14 and a filter element 27 accommodated in the filter casing 14. The filter element 27 is made of, for example, a cylindrical porous material or the like in which micro pores are formed. Further, the inflow chamber 28 and the outflow chamber 29 are formed in the filter casing 24, which are located on the upper and lower ends of the filter element 27, respectively. The fuel filter 26 is adapted to clean the fuel discharged from the fuel pump 25 and flowing into the outflow chamber 29 though the filter element 27.

Figure 8:
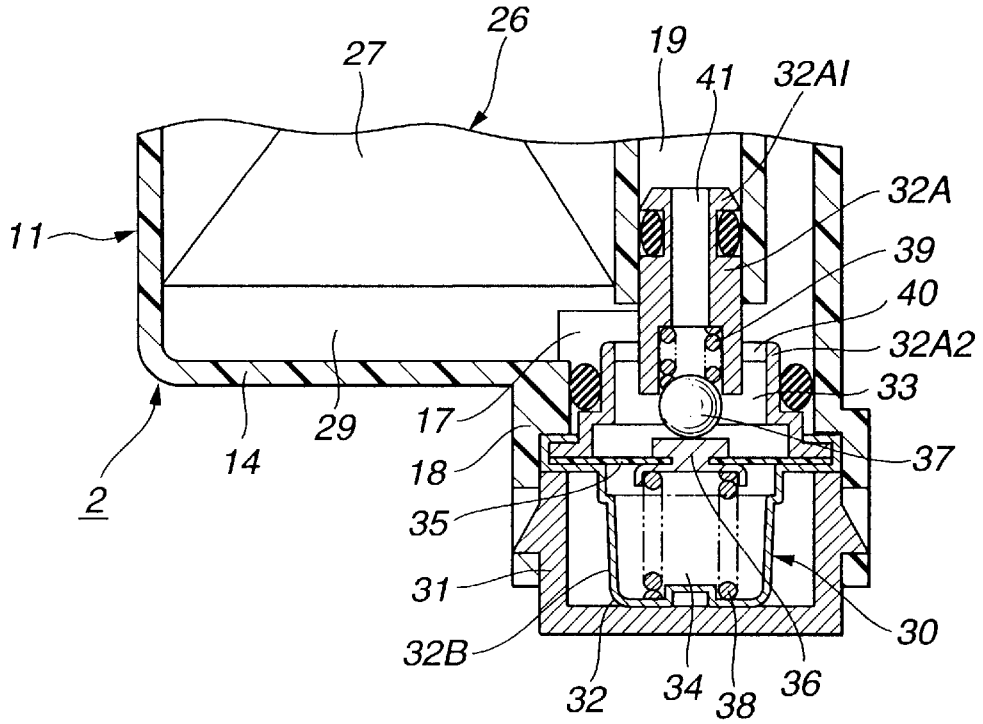
FIG. 8 is an enlarged sectional view of an essential part of a pressure regulator.

As is seen from FIG. 8, the pressure regulator 30 is attached to the regulator mounting part 18 of the mounting bracket 2 with the use of a cap 31, which comprises a regulator casing 32 composed of upper and lower casing parts 32A, 32B, a diaphragm 35 formed of a thin membrane made of a flexible material such as rubber, and clamped at its outer peripheral side between the casing parts 32A, 32*b* of the regulator casing 32 so as to define a fuel inflow chamber 33 and a spring chamber 34 in the regulator casing 32, and an armature 36 fixed to the inner peripheral side of the diaphragm 35.

Furthermore, the pressure regulator 30 includes a ball valve element 37 located in the fuel inflow chamber 33, abutting against the armature 36 and adapted to displace in response to movement of the diaphragm 35, a pressure setting spring 38 located in the spring chamber 34, abutting against the armature 36 so as to constantly urge the diaphragm 3 toward the fuel inflow chamber 33, and a valve element spring 39 for urging the ball valve element 37 toward the spring chamber 34 with a small force.

The upper casing part 32A of the regulator casing 32 is formed into a double cylindrical shape, that is, it is composed of an outer cylindrical part 32A1 that is fitted in the regulator mounting part 18 and an inner cylindrical part 32A2 that is fitted in the return pipe 19. An inflow port 40 is formed between these cylindrical parts 32A1, 32A2. The inner cylindrical part 32A2 defines at its inner peripheral side a return port 41 which provides ON and OFF communications with the inflow chamber 33 when the ball valve element 37 is lifted from and seated onto an end face (valve seat) of the inner cylindrical part 32A2.

Fuel flows from the outflow chamber 29 of the fuel filter 26 into the fuel inflow chamber 33 through the inflow port 40. When the pressure of the fuel exceeds a given pressure set by means of the pressure setting spring 38, the fuel in the fuel inflow chamber 22 is caused to flow from the return port 41 into the return pipe 19. Thus, the pressure regulator 30 can keep the pressure of fuel, which is led from the fuel pump 25 to the injection valves 50, at a given level.

Figure 2:
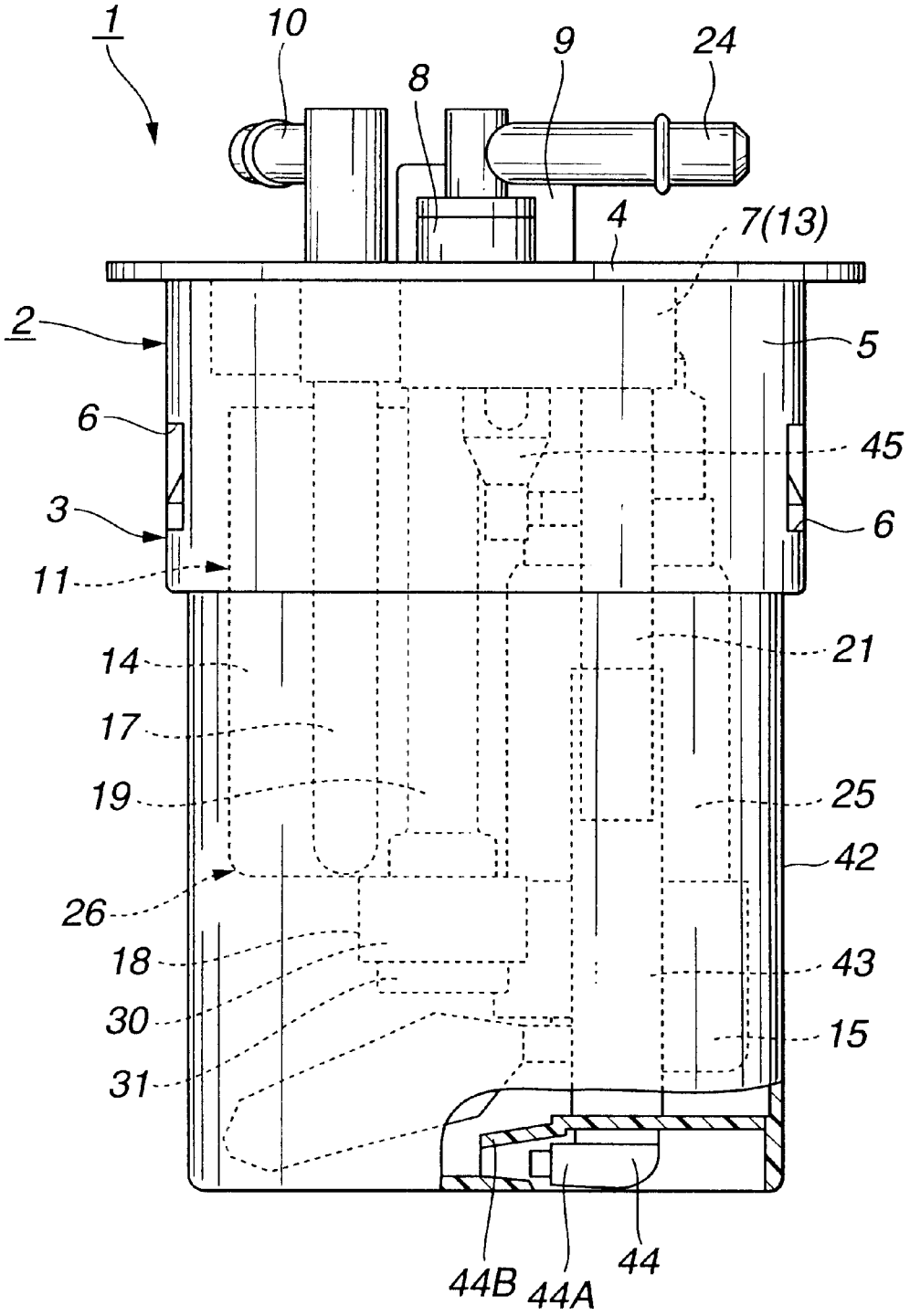
FIG. 2 is a front view of the fuel supply device of the first embodiment.

As is seen from FIGS. 2 and 6, the chamber member 42 is located in the main tank Tm, and is formed of a bottomed cylindrical casing having an upper end opened and a lower end closed. The chamber member 42 is attached at its upper end to the outer barrel part 5 of the mounting bracket 2 which is arranged surrounding the lower section 11 and the fuel pump 25. The pump pipe 43 for leading the return fuel into the chamber suction pump 44 is planted to the bottom part of the chamber member 42, and is attached at its upper part to the suction pump mounting barrel part 21 of the mounting bracket 2.

The chamber member 42 defines therein a fuel sump around the fuel pump 25. Thus, even if the level of fuel in the fuel tank T is lowered or inclined, the suction port 25A of the fuel pump 25 can be constantly submerged in the fuel.

As is seen from FIG. 2, the chamber suction pump 44 is a first suction pump located near an apertured bottom of the chamber member 42, which is composed of the nozzle part 44A having a base end connected to the pump pipe 43 and a leading end opened into the chamber member 42, and a suction part 44B formed in a conical barrel surrounding the nozzle part 44A and having a base end opened outside of the chamber member 42 and a leading end reduced in diameter and opened into the chamber member 42. The chamber section pump 44 thus constitutes a so-called jet pump.

Fuel flows from the fuel return passage 20 into the nozzle part 44 through the suction pump mounting barrel part 21 and the pump pipe 43, and then flows out from the leading end of the nozzle part 44A at a high flow rate. During this flow, the stream of fuel induces a negative pressure in the suction part 44B. Accordingly, the chamber pump 44 sucks fuel from the outside of the chamber member 42 into the suction part 44B and leads the fuel into the chamber member 42 together with the return fuel flowing out from the nozzle part 44A.

As is seen from FIGS. 5 and 9, the sub-tank suction pump 45 is a second suction pump provided to the mounting bracket 2, which is composed of a conical nozzle part 45A having a base end fitted in the suction pump fitting hole 22 of the mounting bracket 2 and a leading end reduced in diameter and opened outside of the return passage, and a suction part 45B in the form of a conical barrel surrounding the suction nozzle part 45A.

The nozzle part 45A is provided thereto with a projecting piece 45A1 which isolates the connection between the fuel return passage 20 and the fuel suction chamber 23 in corporation with the partitions 13 of the lower section 11. The upper part of the projecting piece 45A1 is joined thereto with the partitions 7 of the upper section 3.

The suction part 45B is integrally incorporated at its base end with the lower panel part 12 of the mounting bracket 2, and is communicated at its inner peripheral side with the fuel suction chamber 23 through a suction passage part 45C formed in the lower panel part 12. Further, the suction part 45B is opened at its leading end to the outside of the fuel return passage 20.

When, under operation of the suction pump 45, flowing into the nozzle part 45A from the fuel return passage 20, the fuel ejects out from the leading end of the nozzle part 45A at a high speed, and at this time, the fuel induces a negative pressure in the suction part 45B. Accordingly, the sub-tank suction pump 45 sucks the fuel into the suction part 45B from the sub-tank Ts of the fuel tank T through the suction pipe 51, the suction pipe 24, the fuel suction chamber 23 and the suction passage part 45C, and feeds the fuel into the main tank Tm (viz., chamber member 42) together with the return fuel flowing out from the nozzle part 45A.

Referring back to FIG. 1, an engine proper 46 is mounted in an engine room 47. A fuel pipe line 48 is provided for feeding fuel into the engine proper 46, having an upstream end connected to the supply pipe 10 in the fuel supply device 1, and a downstream end connected to a fuel pipe 49 attached to the engine proper 46. The fuel pipe 49 is attached thereto with the fuel injection valves 50 corresponding to cylinders of the engine proper 46, and the fuel pipe 49 has a closed end on the downstream part.

The suction pipe 51 extends between the main tank Tm and the sub-tank Ts, having an upstream part located in the sub-tank Ts and a downstream part connected to the suction pipe 24 of the fuel supply device 1.

In the following, operation of the fuel supply device 1 will be described with the aid of drawings.

As is seen from FIG. 6, when the fuel pump 25 is driven, fuel is sucked from the chamber member 42 into the suction port 25A, and then discharged from the discharge port 25B into the inflow chamber 28 of the fuel filer 26. The discharged fuel is filtered by the filter element 27, and is then discharged into the inflow chamber 29, and thereafter, a part of the fuel is led into the fuel pipe 49 through the supply pipe 17, the supply pipe 10 and the fuel supply pipe line 48. Thus, the fuel is injected into the cylinders of the engine proper 46 from the fuel injection valves 50.

During this, a part of the fuel reaching the outflow chamber 29 flows from the return port 41 of the pressure regulator 30 into the fuel return passage 20 through the return pipe 19. A part of the fuel in the fuel return passage 20 flows into the nozzle part 44A of the chamber suction pump 44 through the suction pump mounting barrel part 21 and the pump pipe 43 in a manner to drive the suction pump 44. Furthermore, the fuel in the fuel return passage 20 flows into the nozzle part 45A of the sub-tank suction pump 45 in a manner to drive the suction pump 45.

Figure 10:
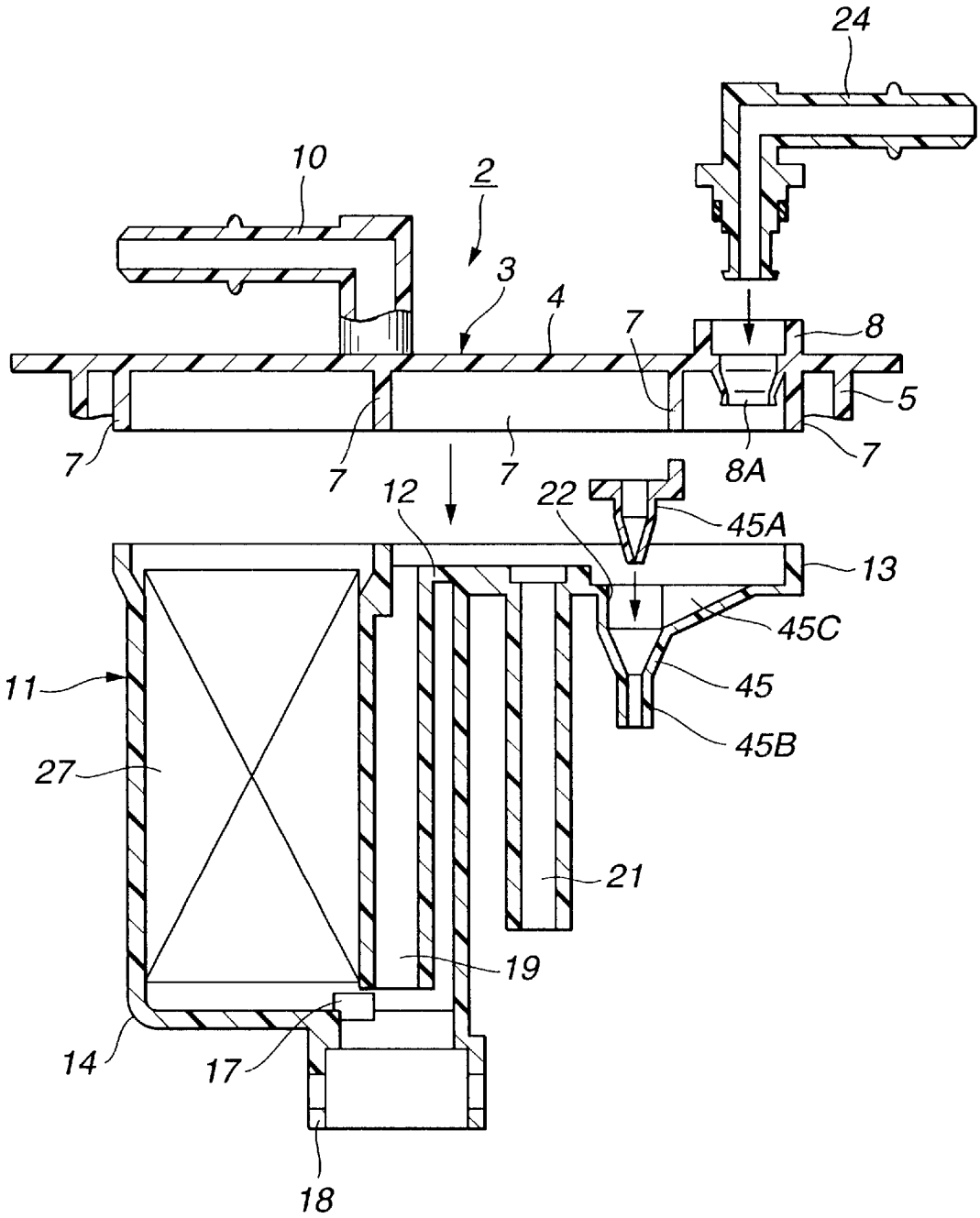
FIG. 10 is an exploded sectional view of the fuel supply device of the first embodiment.

As is seen from FIG. 10, for producing and assembling the fuel supply device 1, the upper section 3 and lower section 11 are molded by, for example, injection molding or the like, and thereafter, the filter element 27 is inserted in the filter casing 14 shaped in the lower section 11, and the nozzle part 45A of the sub-tank suction pump 45 is fitted in the suction pump fitting hole 22.

Then, the upper section 3 and the lower section 11 are joined together. With these steps, there is provided the mounting bracket 2 to which the fuel pump 25, the pressure regulator 30, the suction pipe 24, the chamber member 42, the chamber suction pump 44 are attached, and thus the fuel supply device 1 is assembled.

As is understood from the above description, in the fuel supply device 1 of the first embodiment, the mounting bracket 2 is formed with the fuel return passage 20 connected to the return port 41 of the pressure regulator 30, and the mounting bracket 2 is further formed with the suction pump mounting barrel part 21 and the suction pump fitting hole 22 which are connected in parallel to the fuel return passage 20. Thus, under operation of the fuel pump 25, the return fuel from the pressure regulator 30 can be led into the suction pump mounting barrel part 21 and the suction pump fitting hole 22 separately.

The return fuel can be led into the chamber suction pump 44 through the suction pump mounting barrel part 21, and can be led into the sub-tank suction pump 45 fitted in the suction pump fitting hole 22. Thus, the two suction pumps 44, 45 can be driven individually by the return fuel from the pressure regulator 30.

With this arrangement, the two suction pumps 43, 45 can be easily mounted to the mounting bracket 2, and thus it is possible to provide the fuel supply device 1 adapted to be used in the saddle-like fuel tank T incorporating the chamber member 42, which has a simple structure.

In case of using the fuel supply device in a saddle-like fuel tank T of a type having no chamber member, it is only necessary to remove the chamber member 42 and the chamber suction pump 44 from the fuel supply device, and to block the suction pump mounting barrel part 21 of the mounting bracket 2 with a plug or the like. Thus, production of a fuel supply device having only the sub-tank suction pump 45 is simply and readily made.

Furthermore, when the fuel supply device is used for a usual box-like fuel tank incorporating the chamber 42, nor for the saddle-like type, it is only necessary to remove the nozzle part 45A of the sub-tank suction pump from the lower section 11 of the mounting bracket 2 while a plug for blocking the suction part 45B (viz., the suction pump fitting hole 22) is provided, and to provide a plug in the boss part 8 of the upper section 3. Thus, in this case, production of a fuel supply device having only the chamber suction pump 44 is simply and readily made. For the same reasons, production of a fuel supply device removing both suction pumps 44 and 45 is simply and readily made.

Thus, according to this embodiment, no special design changes are needed for applying the fuel supply device to various kinds of vehicles, and it is possible to cope with these various kinds of vehicles with the use of only one kind of the mounting bracket 2, that is, the mounting bracket 2 can be used commonly for various specifications. Thus, the number of parts for the fuel supply device 1 can be reduced.

Since the fuel return passage 20 is provided by joining the upper section 3 and the lower section 11 which are individually molded, the fuel return passage 20 can be defined as a wide space widened horizontally between the upper section 3 and the lower section 11. Thus, the two suction pumps 44, 45 (or the suction pump mounting barrel part 21 and the suction pump fitting hole 22), which are connected in parallel to the fuel return passage 20, can be easily arranged. Thus, the two suction pumps 44, 45 are easily connected to the fuel return passage 20 with a simple structure, and the mounting bracket 2 can reduced in size.

The mounting bracket 2 is provided by joining the upper section 3 and the lower section 11. Thus, the nozzle part 45 can be fitted in the suction part 45*b* of the sub-tank suction pump 45 formed in the lower section 11, from the upper side during assembly of the mounting bracket 2. Thus, it is possible to simply form a double barrel type suction pump.

For forming the sub-tank suction pump 45, the following method may be used in place of the above-mentioned forming process. That is, there may be used such a process that the suction part 45B is attached to the lower section 11 by means of bonding, welding or the like at a position where it surrounds the nozzle 45A which has been previously formed in the lower section 11. With this process, the double barrel suction pump 45 can be readily formed.

The suction pump mounting barrel part 21 and the suction pump fitting hole 22 are integrally incorporated with the lower section 11. Thus, upon molding of the lower section 11, the suction pump mounting barrel 21 and the suction pump fitting hole 22 can be simply formed at the position where the fuel return passage 20 is located.

The upper section 3 is integrally formed with both the upper panel part 4 that is fixed to the fuel tank T and the supply pipe 10 that feeds fuel outside of the fuel tank T. The lower section 11 is integrally incorporated with the filter casing 14 and the pump mounting part 15. Thus, the fuel pump 25 and the fuel filter 26 can be formed into an integral unit and thus can be compact in size. Even though the overall structure becomes complicated, the workability for assembling the fuel supply device 1 is enhanced with the use of the upper section 3 and the lower section 11.

Figure 11:
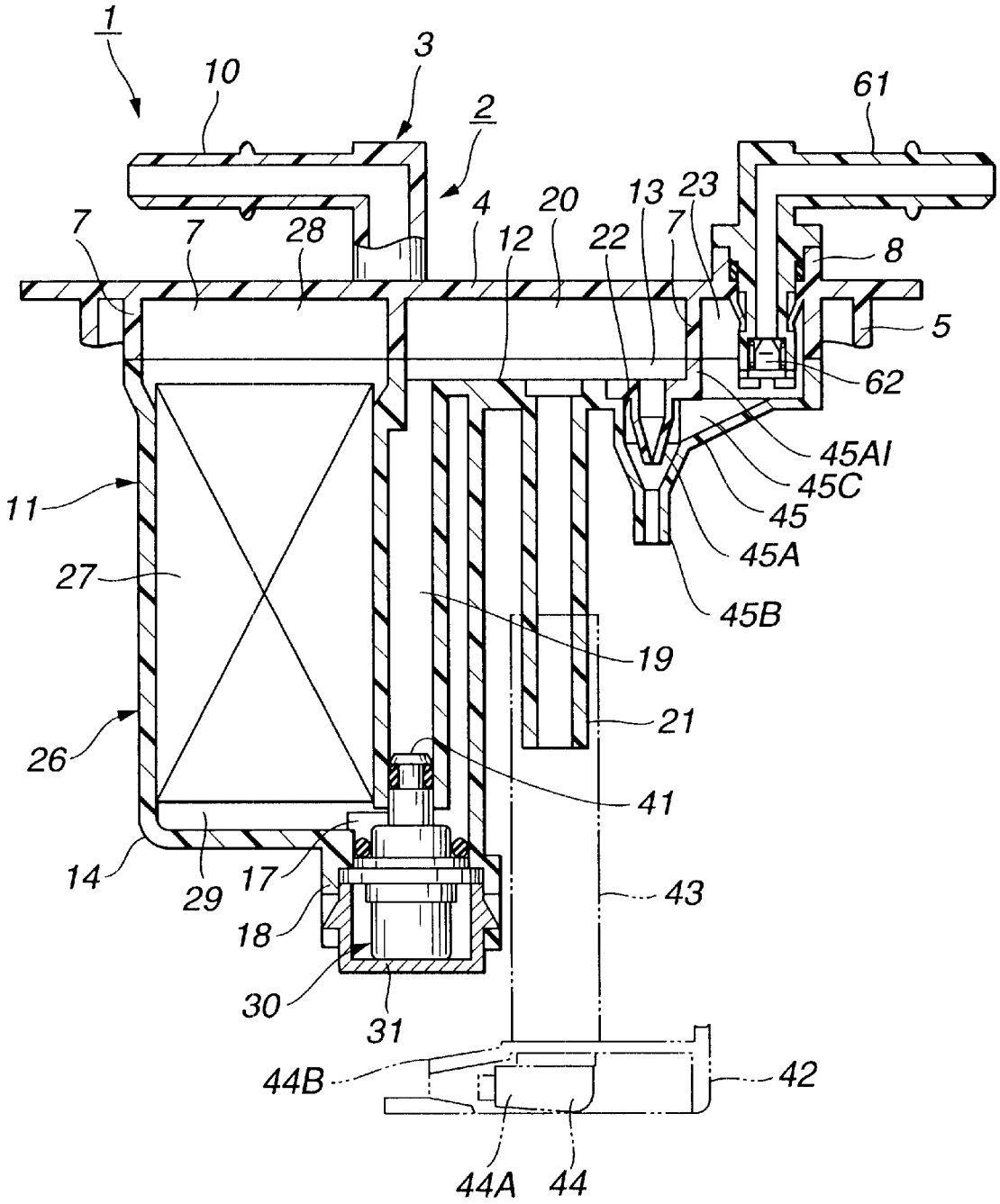
FIG. 11 is a view similar to FIG. 7, but showing a fuel supply device of a second embodiment of the present invention.
Figure 12:
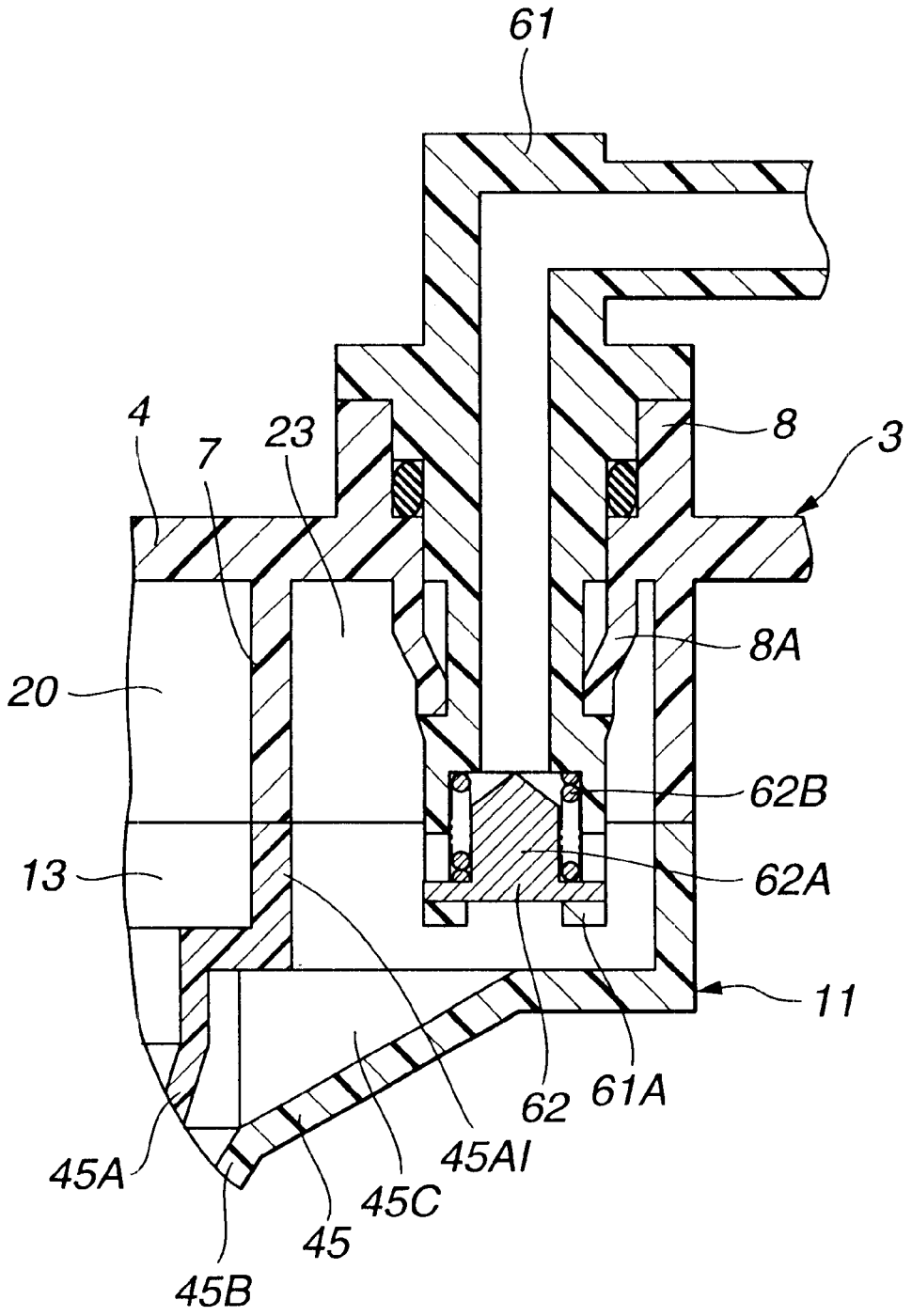
FIG. 12 is an enlarged view of a part of FIG. 11, where a suction pipe and a check valve are provided.

In the following, a second embodiment of the present invention will be described with reference to FIGS. 11 and 12.

The essential feature of this embodiment is the provision of a check valve in a fuel introduction part for leading fuel from the sub-tank into the second suction pump.

For ease of description and understanding, in the following description, substantially the same parts as those of the above-mentioned first embodiment are denoted by the same reference numerals as in the first embodiment.

A suction pipe 61 is used in the second embodiment in place of the suction pipe 24 in the first embodiment, which, similar to the case of the first embodiment, has a base end removably fitted in the boss part 8 of the upper section 3 and a leading end connected to the suction pipe 51. However, in the suction pipe 61 of this second embodiment, the base end portion is led into the fuel suction chamber 23 and a valve mounting part 61A is provided to the base end portion.

A check valve 62 is attached to the valve mounting part 61A of the suction pipe 62, being located in the fuel suction chamber 23 which serves as a fuel introduction part. The check valve 62 is movably provided in the valve mounting part 61A, and is composed of a valve element 62A for opening and closing the suction pipe 61, and a spring member 62B for urging the valve element 62A in the valve opening direction. The spring member 62B is used to prevent undesired phenomenon wherein the valve element 62A is kept stuck while blocking the suction pipe 61.

The check valve 62 opens the suction pipe 61 to allow fuel to flow into the main tank T when fuel is sucked from the sub-tank Ts by the sub-tank suction pump 45.

If clogging or the like occurs, for example, in the leading end of the suction pump 45 (the suction part 45B), the fuel flowing from the nozzle part 45A tend to flow back toward the sub-tank Ts through the suction pipe 61. However, in this case, the check valve 62 functions to close the suction pipe 61 thereby to inhibit the back flow of the fuel.

Thus, the fuel supply device of the second embodiment can offer technical effects and advantages similar to those obtained by the first embodiment. In particular, in the second embodiment, the check valve 62 is provided in the fuel suction chamber 23, and accordingly, even though clogging or the like occurs in the suction part 45B of the sub-tank suction pump 45, the fuel flowing out from the nozzle part 45A can be prevented from flowing back toward the sub-tank Ts due to provision of the check valve 62. That is, the reliability is much assured in the second embodiment.

Figure 13:
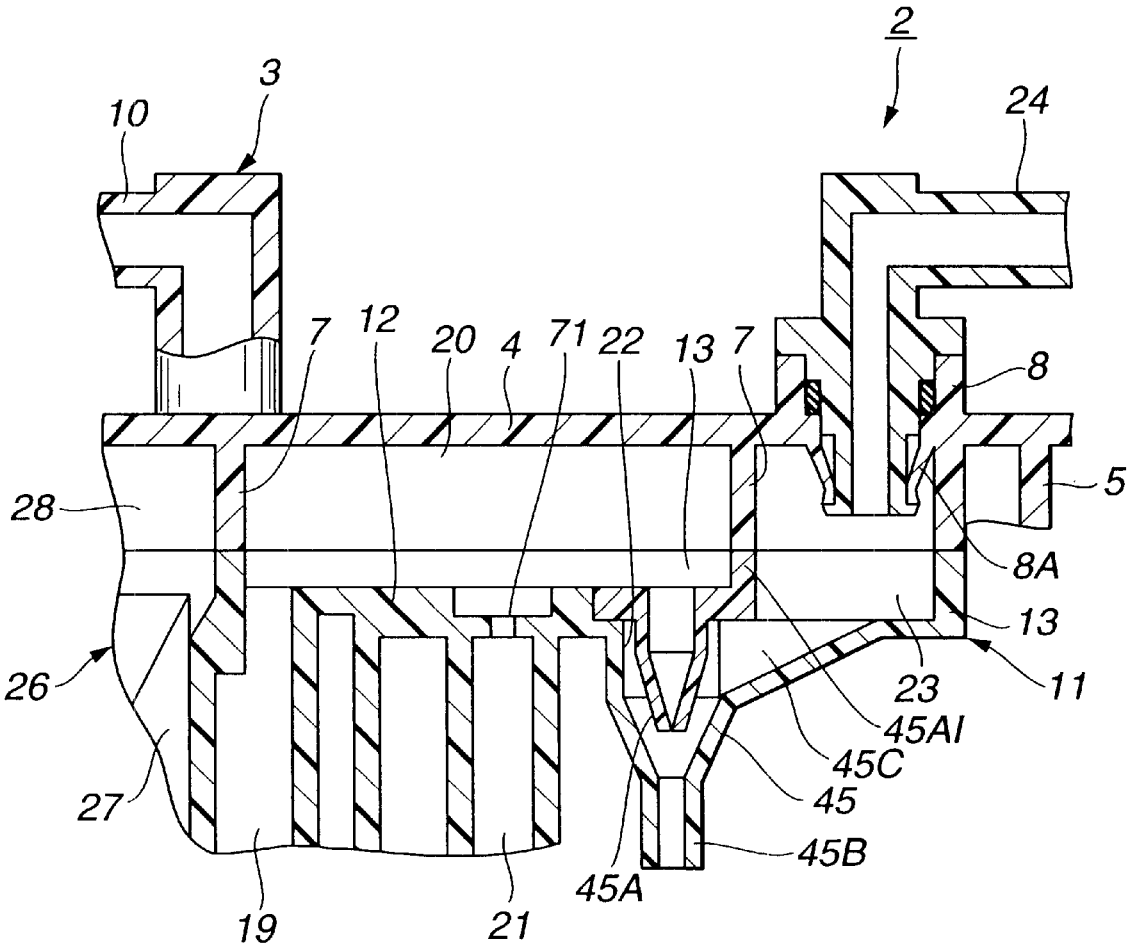
FIG. 13 is an enlarged sectional view of an essential part of a fuel supply device which is a third embodiment of the present invention.

In the following, a third embodiment of the present invention will be described with reference to FIG. 13.

The essential feature of this embodiment is the provision of an orifice 71 for adjusting the flow rate of the return fuel, in the first suction pump mounting part. Substantially the same parts as those of the above-mentioned first embodiment are denoted by the same reference numerals as in the first embodiment.

The orifice 71 is provided between the fuel return passage and the suction pump mounting barrel part 21 so as to reduce the bore of a passage which communicates the fuel return passage 20 with the suction pump mounting barrel part 21. The orifice 71 applies a resistance to the return fuel flowing from the fuel return passage 20 to the suction pump mounting barrel part 21. Thus, due to work of the orifice 71, the fuel from the fuel return passage 20 is suitably distributed to both the chamber suction pump 44 and the sub-tank suction pump 45.

Thus, also the fuel supply device of the third embodiment can offer technical effects and advantages similar to those obtained by the first embodiment. In particular, in the third embodiment, the flow rate between the flow of fuel led from the fuel return passage 20 into the chamber suction pump 44 and the flow of fuel led therefrom to the sub-tank 45 is be suitably adjusted in accordance with the bore diameter of the orifice 71. Accordingly, if the flow rates of fuel led to the suction pumps 44, 45 differ from each other, it can easily cope therewith only by changing the orifice 71 having a different orifice diameter.

Figure 14:
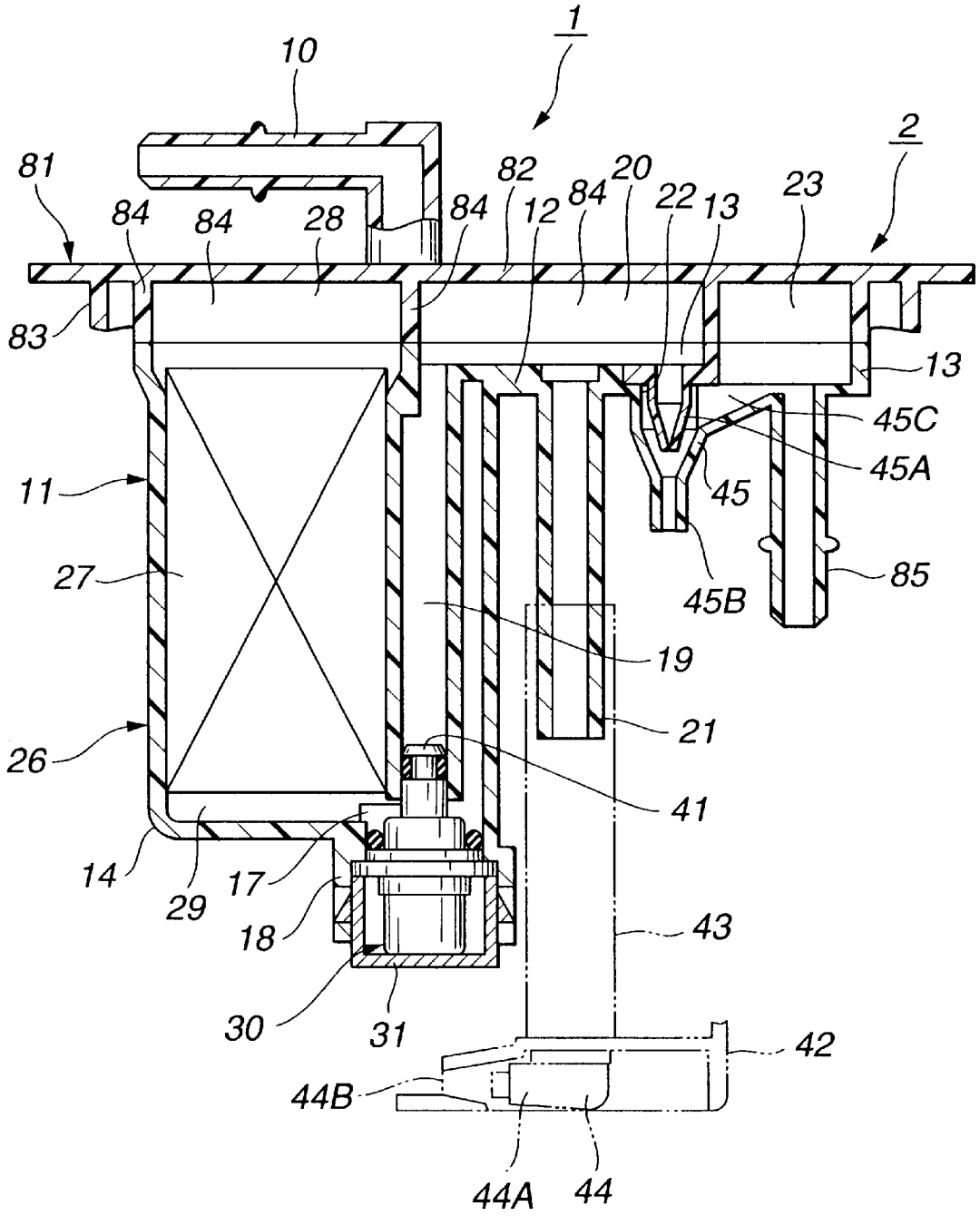
FIG. 14 is a view similar to FIG. 7, but showing a fuel supply device of a fourth embodiment of the present invention.

In the following, a fourth embodiment of the present invention will be described with reference to FIG. 14.

The essential feature of this embodiment is the provision of a suction pipe in the fuel tank. Substantially the same parts as those of the above-mentioned first embodiment are denoted by the same reference numerals as in the first embodiment.

An upper section 81 is used in this third embodiment in place of the upper section 3 used in the first embodiment, which is composed of an upper panel part 82, an outer cylindrical part 83 and a plurality of partitions 84, which are similar to those of the upper section 3 in the first embodiment.

However, in the fourth embodiment, there is no structure corresponding to the boss part 8 used in the upper section 3 in the first embodiment. A suction pipe 85 is provided in the fuel tank T, being directed downward.

The suction pipe 85 is formed in the lower panel part 12 of the lower section 11, which has a base end communicated with the fuel suction chamber 23, and a leading end extending downward in the main tank Tm. To the leading end of the suction pipe 85, there is connected the suction pipe 51 which extends from the sub-tank Ts of the fuel tank T.

Thus, also the fuel supply device of the fourth embodiment can offer technical effects and advantages similar to those obtained by the first embodiment. In particular, in the fourth embodiment, the suction pipe 51 and the suction pipe 85 are located in the main tank Tm, so that the suction pipe 51 can be entirely held in the fuel tank T. Accordingly, the fuel tank T can be simplified in structure, and the piping work for the tank can be simply made.

Figure 15:
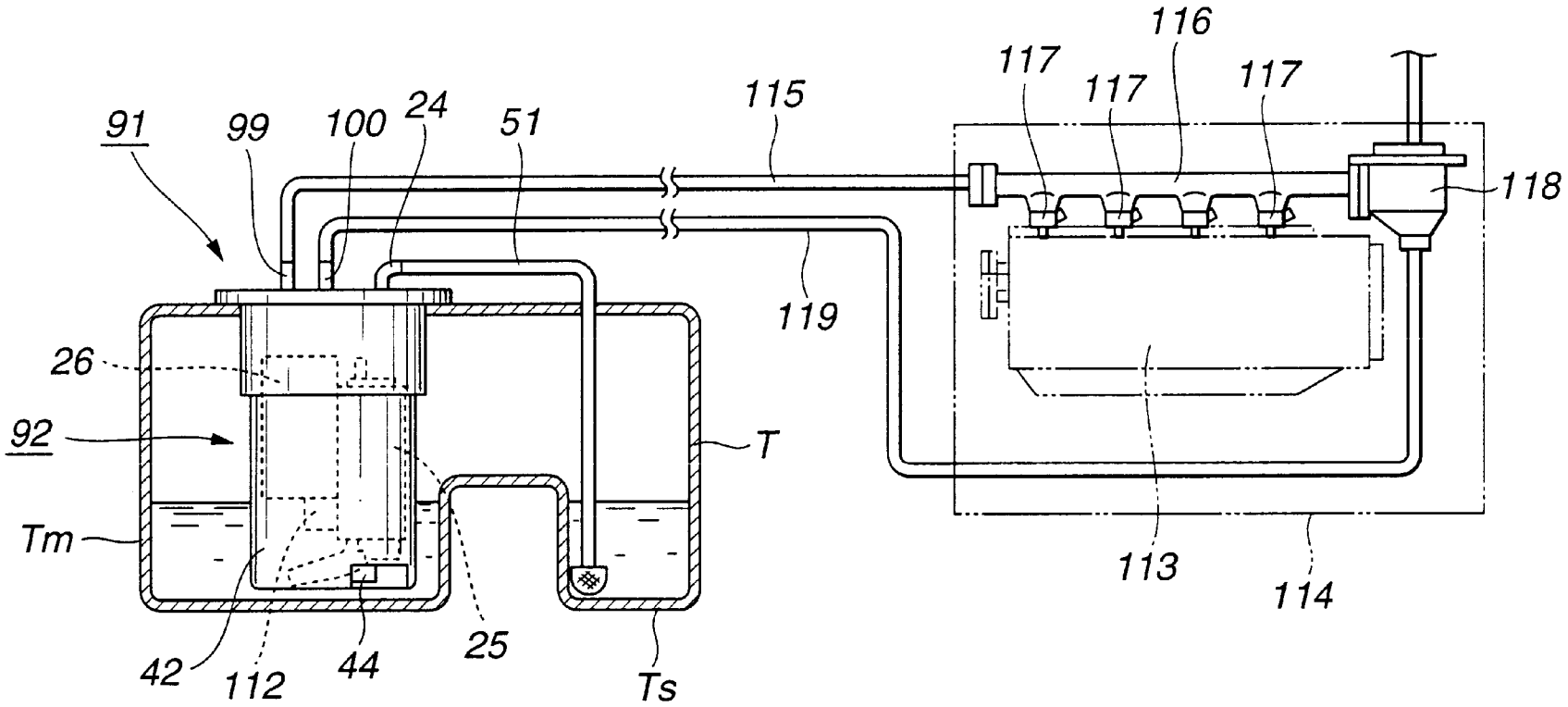
FIG. 15 is a schematic view of a fuel supply system of full-return type to which a fuel supply device of a fifth embodiment of the invention is practically applied.

In the following, a fifth embodiment of the present invention will be described with reference to FIGS. 15 and 16.

The essential feature of this embodiment is the usage of a fuel supply device 91 in a full-return type fuel supply system. The substantially the same parts as those of the above-mentioned first embodiment are denoted by the same reference numerals as in the first embodiment.

The fuel supply device 91 is used in this fifth embodiment in place of the fuel supply device 1 used in the first embodiment, which is composed of a mounting bracket 92, a fuel pump 25, a fuel filter 26, a pressure regulator 118, the chamber member 42, suction pumps 44, 110, which are similar to those of the fuel supply device 1.

However, in the fifth embodiment, the pressure regulator 118 is located outside of the fuel tank T, and is attached to the downstream part of a fuel pipe 116. With this, the fuel supply device 91 constitutes a part of a so-called full return type fuel supply system.

Figure 16:
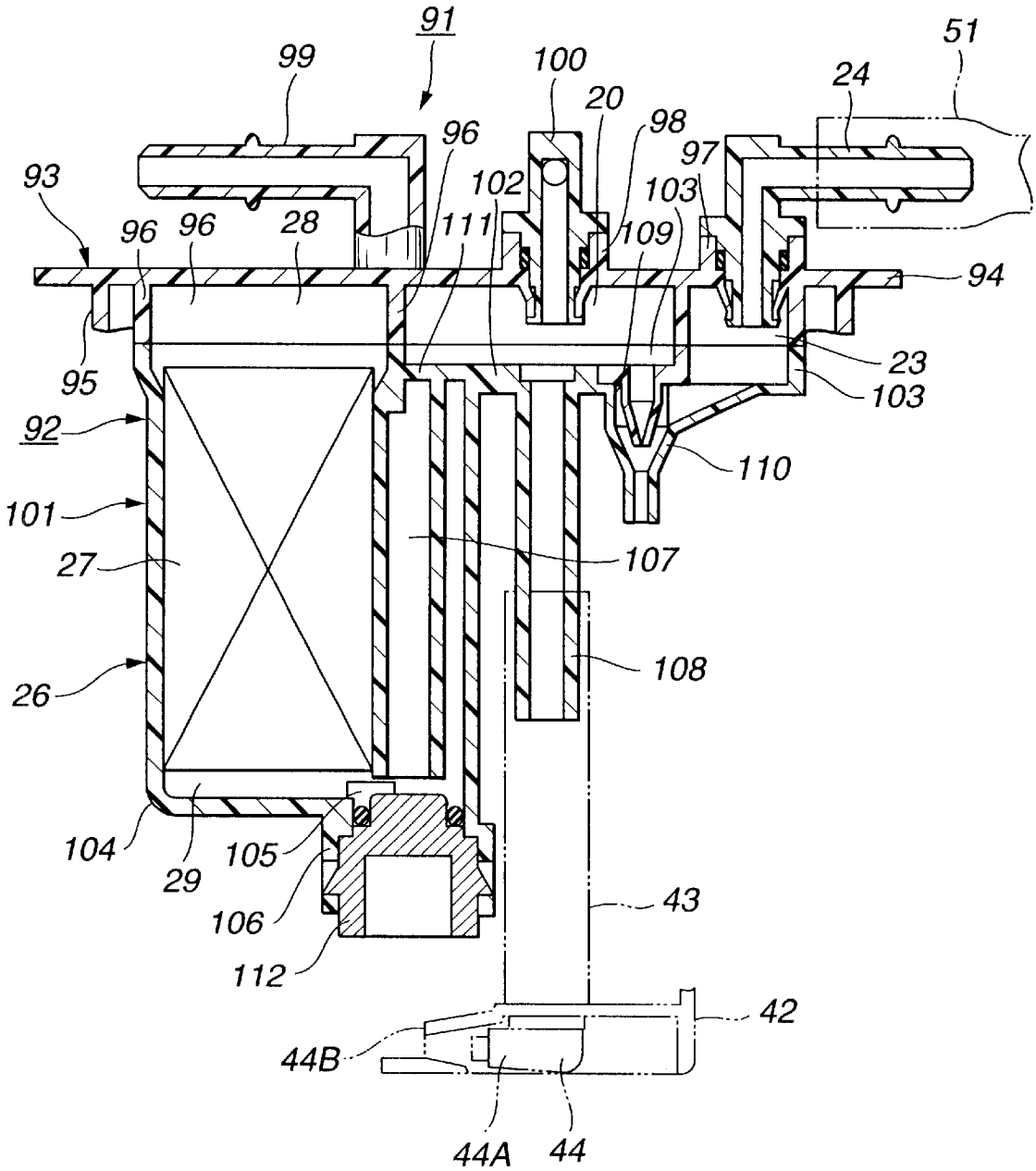
FIG. 16 is a view similar to FIG. 7, but showing the fuel supply device of the fifth embodiment of the invention.

As is seen from FIG. 16, the mounting bracket 92 serves as a main body of the fuel supply device 91, which is composed of an upper section 91 and a lower section 101.

An upper section 93 is made of plastics and mainly composed of an upper panel part 94, an outer cylindrical part 95, a plurality of partitions 96, which are similar to those of the upper section 3 in the first embodiment, the upper panel part 94 being formed thereon with a boss part 97 for the suction pipe 24. The upper section 93 is provided on the upper panel part 94 thereof with another boss part 98 to which a return pipe 100 is connected.

A supply pipe 99 is a supply passage part formed in the upper panel part 94 of the upper section 93, which is connected thereto with a fuel supply pipe 115.

The return pipe 100 is attached to the boss part 98 of the upper section 63, which is connected thereto with a fuel return pipe 119 for returning excessive fuel into the fuel tank T.

A lower section 101 is a lower section in the fifth embodiment, which is composed of a lower panel part 102 and partitions 103, which are similar to those of the lower section 11 in the first embodiment. The lower section 101 also includes a filter casing 104, a pump mounting part and a connection barrel part (both of which are not shown in the figures), a supply pipe 105, a regulator mounting part 106, a blocked pipe part 107, a suction pump mounting barrel 108, a suction pump fitting hole 109 and a sub-tank suction pump 110.

Between the upper section 93 and the lower section 101, there is defined a fuel return passage 20 into which return fuel from a pressure regulator 118 is led through the fuel return pipe 119 and the return pipe 100. This return fuel is adapted to drive the chamber suction pump 44 and the sub-tank suction pump 110 in substantially same manner as in the case of the first embodiment.

However, the lower section 101 in the fifth embodiment differs from the lower section 11 in the first embodiment in that the lower panel part 102 is provided therein with a blocking part 111. In this case, the blocking part 111 can be easily formed during molding of the lower section 101 only by changing a core in the molding dies.

A sealing plug 112 is attached to the regulator mounting part 106 in place of the pressure regulator 30 and the cap 31 in the first embodiment, which isolates the filter casing 104 from the inside of the fuel tank T while communicating the interior of the filter casing 104 with the supply pipe 99.

Referring back to FIG. 15, an engine proper 113 is mounted in an engine room 114. A fuel supply pipe line 115 is provided for supplying fuel into the engine proper 113, having an upstream end connected to the supply pipe 99 and a downstream end connected to a fuel pipe 115 attached to the engine proper. The fuel pipe 116 is attached thereto with a plurality of injection valves 117 corresponding to cylinders in the engine proper 113, and a pressure regulator 118 is connected to the downstream end of the fuel pipe 116. The pressure regulator 118 is connected thereto with a fuel return pipe 119 for returning excessive fuel into the fuel tank T, and the downstream end of the fuel return pipe 119 is connected to the return pipe 100.

Fuel discharged from a fuel pump (not shown) is cleaned by the fuel filter 26 and then led from the fuel tank T into the injection valves 117 through the fuel pipe 99, the fuel supply pipe line 115 and the fuel pipe 116. A part of the fuel is returned from the pressure regulator 118 into the fuel tank T through the fuel return pipe 119 and the return pipe 100.

Thus, also the fuel supply device of the fifth embodiment can offer technical effects and advantages similar to those obtained by the first embodiment. Besides, in the fifth embodiment, the mounting bracket is changed in shape by changing the core of the molding dies in order to use the sealing plug 12 in place of the pressure regulator 30. Thus, the fuel supply device can be applied to a vehicle using a full-return type fuel supply system.

The entire contents of Japanese Patent Application 2000-085027 (filed Mar. 24, 2000) are incorporated herein by reference.

Although the invention has been described above with reference to the embodiments of the invention, the invention is not limited to the embodiments as described above. Various modifications and variations of the embodiments may be carried out by those skilled in the art, in light of the above descriptions.

What is claimed is:

1. A fuel supply device for use with a fuel tank and a pressure regulator, comprising:

a mounting bracket adapted to be suspended into said fuel tank;

a fuel pump mounted to said mounting bracket to pump fuel from the fuel tank to the outside of the fuel tank;

a fuel return passage defined by said mounting bracket, through which a part of the fuel pumped out from said fuel pump is led back into the fuel tank under operation of the pressure regulator;

first and second suction pumps mounted to said mounting bracket and sucking fuel from first and second given portions of the fuel tank by using a power possessed by the fuel led into said fuel return passage, a first passage having one end directly opened to said fuel return passage and the other end connected to said first suction pump; and a second passage having one end directly opened to said fuel return passage and the other end connected to said second suction pump.

2. A fuel supply device as claimed in claim 1, in which said pressure regulator is mounted to said mounting bracket, said pressure regulator regulating the pressure of fuel led to the outside of said fuel tank by returning a part of the fuel from said fuel pump into said fuel tank.

3. A fuel supply device as claimed in claim 2, in which said first and second passages extend in parallel with each other and are perpendicular to said fuel return passage.

4. A fuel supply device as claimed in claim 3, in which said mounting bracket further comprising a return pipe passage which extends from a return port of said pressure regulator to said fuel return passage, said return pipe passage extending in parallel with said first and second passages.

5. A fuel supply device as claimed in claim 2, further comprising a chamber member which is detachably connected to said mounting bracket and surrounds said fuel pump to define around the same a fuel sump, said first suction pump being positioned in the vicinity of an apertured bottom of said chamber member.

6. A fuel supply device as claimed in claim 2, in which said mounting bracket further comprises a third passage through which fuel is conveyed into the fuel tank when said second suction pump is driven.

7. A fuel supply device as claimed in claim 6, further comprising a check valve which is installed in said third passage to permit only the flow of the fuel toward the second suction pump.

8. A fuel supply device as claimed in claim 2, further comprising an orifice which is arranged between said fuel return passage and said first passage to adjust the flow rate of fuel led from said fuel return passage toward said first passage.

9. A fuel supply device for use with a pressure regulator, comprising:

a fuel tank for containing fuel;

a mounting bracket having an upper part connected to an upper part of said fuel tank and a lower part suspended into the fuel tank;

a fuel pump mounted to the lower part of said mounting bracket to pump fuel in the fuel tank to the outside of said fuel tank;

a fuel return structure integral with said mounting bracket, said fuel return structure having a fuel return passage through which a part of the fuel pumped out from said fuel pump is led back into the fuel tank under operation of the pressure regulator;

first and second suction pumps for conveying fuel from first and second given portions of said fuel tank to a major portion of said fuel tank by using a power possessed by the fuel flowing in said fuel return passage of the fuel return structure;

a first mounting structure integral with said mounting bracket and having said first suction pump mounted thereto, said first mounting structure having a first passage through which the fuel from said fuel return passage flows for driving said first suction pump; and a second mounting structure integral with said mounting bracket and having said second suction pump mounted thereto, said second mounting structure having a second passage through which the fuel from said fuel return passage flows for driving said second suction pump, said first and second passages being connected to said fuel return passage independently.

10. A fuel supply device as claimed in claim 9, in which said pressure regulator is mounted to the lower part of said mounting bracket to regulate the pressure of fuel led to the outside of the fuel tank by returning a part of the fuel from said fuel pump to said fuel tank.

11. A fuel supply device as claimed in claim 10, further comprising a chamber member detachably connected to said mounting bracket and suspected in said fuel tank, said chamber member surrounding said fuel pump to define around the same a fuel sump.

12. A fuel supply device as claimed in claim 11, in which said first suction pump is positioned in the vicinity of an apertured bottom of said chamber member to suck the fuel from the outside of said chamber member and leads the same to the interior of said chamber member.

13. A fuel supply device as claimed in claim 10, in which said fuel tank comprises a main tank and a sub-tank, said main tank having said mounting bracket installed therein, said second suction pump sucks the fuel from said sub-tank and feeds the same to the main tank.

14. A fuel supply device as claimed in claim 13, further comprising:

a fuel leading passage defined by said mounting bracket, through which the fuel in the sub-tank is led to the main tank by said second suction pump; and a check valve installed in said fuel leading passage for permitting only a flow of the fuel from said sub-tank toward said main tank.

15. A fuel supply device as claimed in claim 10, in which said mounting bracket comprises:

an upper section of molded plastics; and a lower section of molded plastics, said upper and lower sections being coupled together to define therebetween said fuel return passage.

16. A fuel supply device as claimed in claim 10, further comprising an orifice which is disposed in said first passage of said first mounting structure to adjust the flow rate of the fuel directed from said fuel return passage toward said first section pump.

17. A fuel supply device as claimed in claim 15, in which said upper section of said mounting bracket comprises:

a fixing portion fixed to said upper part of said fuel tank; and a fuel conveying passage through which the fuel from said fuel pump is conveyed to the outside of said fuel tank.

18. A fuel supply device as claimed in claim 17, in which said lower section of said mounting bracket comprises:

a pump mounting portion to which said fuel pump is mounted; and a filter casing in which a filter element is accommodated, said filter element being arranged to clean the fuel which is discharged from said fuel pump.

19. A fuel supply device for use with a fuel tank, comprising:

a mounting bracket adapted to be suspended into said fuel tank;

a fuel pump mounted to said mounting bracket to pump fuel from the fuel tank to the outside of the fuel tank;

a pressure regulator mounted to said mounting bracket to regulate the pressure of fuel led to the outside of the fuel tank by returning a part of the fuel from said fuel tank into said fuel tank;

a fuel return passage defined by said mounting bracket, through which the part of the fuel pumped out from said fuel pump is led back to the fuel tank under operation of the pressure regulator;

first and second suction pumps mounted to said mounting bracket and sucking fuel from first and second given portions of the fuel tank by using a power possessed by the fuel led into said fuel return passage;

a first passage having one end directly opened to said fuel return passage and the other end connected to said first suction pump; and a second passage having one end directly opened to said fuel return passage and the other end connected to said second suction pump.

20. A fuel supply device for use with a fuel tank, comprising:

a mounting bracket adapted to be suspended into said fuel tank;

a fuel pump mounted to said mounting bracket to pump fuel from the fuel tank to the outside of the fuel tank;

a fuel return passage defined by said mounting bracket, into which a part of the fuel pumped out from said fuel pump is led under operation of a pressure regulator;

first and second suction pumps mounted to said mounting bracket and sucking fuel from first and second given portions of the fuel tank by using a power possessed by the fuel led into said fuel return passage;

a first passage having one end directly opened to said fuel return passage and the other end connected to said first suction pump; and a second passage having one end directly opened to said fuel return passage and the other end connected to said second suction pump.

* * * * *